US006805433B1

(12) United States Patent
Raisanen et al.

(10) Patent No.: US 6,805,433 B1
(45) Date of Patent: Oct. 19, 2004

(54) INTEGRATED SIDE SHOOTER INKJET ARCHITECTURE WITH ROUND NOZZLES

(75) Inventors: Alan D Raisanen, Sodus, NY (US); Shelby F Nelson, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/440,177

(22) Filed: May 19, 2003

(Under 37 CFR 1.47)

(51) Int. Cl.[7] ..... B41J 2/05
(52) U.S. Cl. ..... 347/65
(58) Field of Search ..... 347/65, 63, 56, 347/54, 92, 90, 86, 85, 84; 216/4, 48; 29/890.1; 430/311

(56) References Cited

U.S. PATENT DOCUMENTS 5,738,799 A 4/1998 Hawkins et al.

*Primary Examiner*—Raquel Yvette Gordon
(74) *Attorney, Agent, or Firm*—Oliff & Berridge, PLC

(57) ABSTRACT

A method of manufacturing a fluid ejection device having circular nozzles includes forming channels in a substrate, depositing a sacrificial material, such as photoresist, into channels to form a mold for the fluid channels and a fluid reservoir and then forming the remainder of the fluid ejection device above the sacrificial material on the substrate. Various novel fluid heater structures and an in situ fluid filter may be formed during the manufacturing process. The fluid ejection device can include a heater element located in the fluid chamber behind the nozzle opening. The geometry of the heating element can be planar. Alternatively, the heating element can be located inside the channel in either a half-cylindrical or fully-cylindrical configuration. The internal fluid pathways remain protected from contaminants by the sacrificial material. After all layers and manufacturing processes are complete, individual fluid ejection devices are diced and the sacrificial material is removed.

23 Claims, 5 Drawing Sheets

INTEGRATED SIDE SHOOTER INKJET ARCHITECTURE WITH ROUND NOZZLES

BACKGROUND OF THE INVENTION

1. Field of Invention

This invention relates generally to the structure, design and manufacturing of side shooter fluid drop ejectors.

2. Description of Related Art

Fluid ejection systems, such as ink jet printers, typically employ an array of electrically controllable ejectors in the ejector head that are usable to eject fluid drops onto a receiving medium, such as paper. In a thermal fluid ejection system, electric current is applied to a resistive heater in the ejector head, vaporizing fluid in a fluid chamber. The rapid expansion of fluid vapor causes a fluid drop to be ejected through a fluid path and out the ejector opening or nozzle. Alternatively, non-thermal fluid ejection systems rely on an over-pressure due to mechanical compression caused by a piezoelectric element or mechanical pressure pulse to selectively eject a fluid drop from the ejector nozzle.

Fluid ejection heads utilizing thermal or mechanical ejectors are typically manufactured in a modular manufacturing process, where various layers that make up the ejector head are formed separately and then bonded together. The bonded layers arc then diced into individual fluid ejector head units. For example, in a typical thermal fluid ejection head, a bottom layer, formed using a silicon substrate, contains a plurality of nozzle heating elements, one for each ejector nozzle, as well as the heater electronics and transducers for the heating elements. A polymer layer is placed over the heater layer and is used to form the fluid channels and nozzle walls. Finally, a channel wafer is placed over the polymer layer and is used to form ink inlets, ink reservoirs and nozzle roofs.

SUMMARY OF THE INVENTION

The conventional fluid ejector head architecture offers precise control over the nozzle size but limits the nozzle geometry to geometric, straight-walled, cornered shapes such as triangles, squares, or rectangles. Also, bonding and dicing of the sandwiched layers adds significant packaging complexity and increases yield losses due to chipping, contamination from dicing debris and wafer bonding adhesive that enters into the channels, wafer/polymer layer misalignment, and de-lamination of the layers. As a result of these problems, manufacturing costs are typically high.

This invention provides side shooting fluid ejection heads that do not use bonded layers to form the channel structures.

This invention separately provides side-shooting fluid ejection heads that use a sacrificial material as a mold around which structural layers are formed to provide the channel structures.

This invention separately provides a side-shooting thermal fluid ejection head that has a channel structure in which the thermal element is formed on one or more walls of structural material layers used to form the channel structure.

This invention further provides a side-shooting fluid ejection head that has a channel structure in which the thermal clement is formed to completely extend around an inner surface of the structural material layers used to form the channel structure.

This invention separately provides a side-shooting fluid ejection head that has a channel structure having a circular cross section along at least one portion.

This invention further provides aside shooting fluid ejection head that has a channel structure that has a circular nozzle opening.

This invention separately provides a fluid ejection head that has an integrated channel stricture and upstream fluid filter.

This invention separately provides methods for forming channel structures using structural material layers formed around a sacrificial material used as a mold.

This invention separately provides systems and methods of manufacturing a fluid ejection system that protects internal portions from contamination from dicing and bonding adhesives during the manufacturing process by using sacrificial mold materials.

This invention separately provides methods for forming a channel structure of a thermal side-shooting fluid ejector head having a beating element formed at least partially around an inner surface of the channel structure.

This invention separately provides systems and methods for manufacturing a fluid ejection system that is based on forming fluid micro channels on a substrate.

In various exemplary embodiments of the method of manufacturing a fluid ejection system according to this invention, channels are formed in a base substrate. In various exemplary embodiments, the channels are etched in the substrate. In various exemplary embodiments, a sacrificial material is formed in the channels and on the substrate. The sacrificial material is patterned to define a negative space that will become at least one fluid reservoir and a plurality of fluid ejection channels fluidly connected to the fluid reservoir.

In various exemplary embodiments, the fluid ejection system includes a beater element located in the fluid chamber behind the nozzle opening. In various exemplary embodiments, the geometry of the heating element is planar. In various other exemplary embodiments, the heating element is located inside the channel in either a half-cylindrical or fully-cylindrical configuration.

In various exemplary embodiments, a method of manufacturing a fluid ejector according to this invention includes a fluid filter constructed at the wafer level. In various exemplary embodiments, the fluid filter includes a layer above a fluid reservoir that is etched with a pattern of holes to produce a filter for the fluid.

These and other features and advantages of this invention are described in or are apparent from the following detailed description of various exemplary embodiments of the systems and methods according to this invention.

BRIEF DESCRIPTION OF THE DRAWINGS

Various exemplary embodiments in the invention will be described in detail with reference to the following figures, wherein.

DETAILED DESCRIPTION OF EXEMPLARY EMBODIMENTS

The following detailed description of various exemplary embodiments of a fluid ejection system according to this invention may refer to one specific type of fluid ejection system, a side shooting thermal ink jet printer, for sake of clarity and familiarity. However, it should be appreciated that the principles of this invention as outlined and/or discussed below, can be equally applied to any known or later developed fluid ejection system, beyond the ink jet printer specifically discussed herein.

Figure 1:
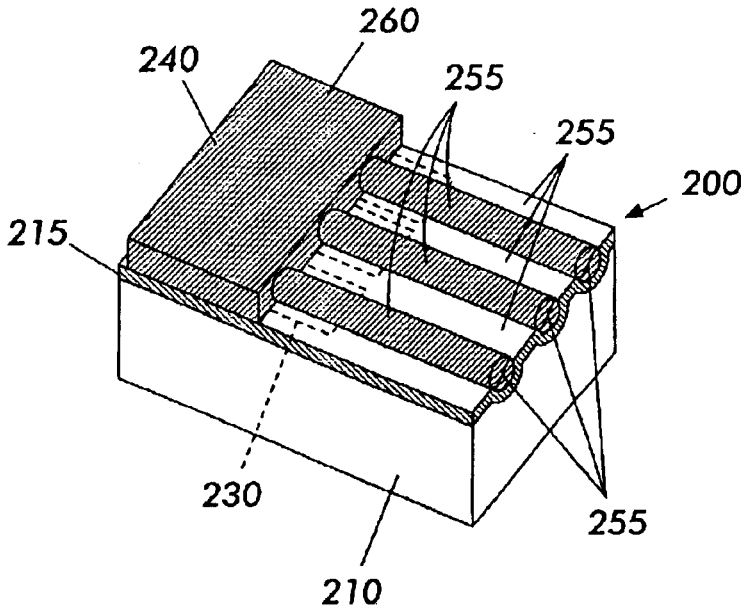
FIG. 1 is a perspective view of a step of one exemplary embodiment of a fluid ejector head manufacturing process according to this invention.

FIG. 1 illustrates a fluid ejector head manufactured according to one exemplary embodiment of a manufacturing method according to this invention. An ejector head region of a substrate 210 of what will become a multi-layer wafer 200, contains a plurality of etched micro channels. The substrate 210 and etched micro-channels are covered with a first permanent layer 215. In various exemplary the embodiments, the first permanent layer 215 is formed by a nitride layer, such as for example, a silicon oxynitride. The first permanent layer 215 forms the bottom surface of the fluid channels 250 and, in various exemplary embodiments, also passivates the substrate 210. A sacrificial layer 240 is applied on the first permanent layer 215 and is patterned to form the nozzle channels 250 and the fluid supply reservoir 260 that will serve as the fluid path. In various exemplary embodiments, the sacrificial layer 240 is formed using a sacrificial material. In various exemplary embodiments, the sacrificial material is a photoresist material. As used herein, the term "sacrificial material" refers to any known or later-developed molding material that can be used to define the inside dimensions of the micro channels and other fluid ejector head negative space components. In various exemplary embodiments, the sacrificial material can also be used to protect these negative space components from contamination during manufacturing. Various ribs, separators and/or bubble and/or flow control structures can easily be included in the shape of the reservoir 260 at this step by forming the sacrificial layer 240 that acts as a mold in the shape of the desired negative space structures. The sacrificial material is later removed with a solvent to create the various negative space components.

In various exemplary embodiments, the sacrificial material is a photoresist, a photo-alterable polymer or any other appropriate selectively-alterable material that can be placed on or over the substrate 210 in one or more layers to fill the micro channels 250 and to form the fluid reservoir 260. In the exemplary embodiments where the sacrificial material is a photoresist or a photo-definable polymer layer, the photoresist or photo-definable polymer layer may be spun on. In such exemplary embodiments, it may be desirable to use a short spin time to minimize flow of the photoresist. In various exemplary embodiments, multiple spins and exposures may be necessary to fill the micro channels 250, since each spin or layer of photoresist is typically only up to 7–9 mm thick. In various exemplary embodiments, the photoresist is re-flowed to form a cylindrical plug in the channels 250. However, it should be appreciated that other cross sectional shapes may be desired that do not require re-flowing the photoresist. Geometric shapes, such as squares, triangles and rectangles, which may be completely formed below the surface of the substrate 210 or which may extend above the surface of the substrate 210, may be manufactured according to this invention.

Selectively removing the sacrificial material, such as by photolithographically patterning and developing the sacrificial material, can be performed to remove substantially all of the sacrificial material that has flowed outside of the desired channel locations onto the flat surface of the substrate 210. In various exemplary embodiments, the nozzle channels 250 are cylindrical. In such exemplary embodiments, the sacrificial material is heated at a sufficient temperature and for a sufficient time to re-flow the sacrificial material and to produce a rounded cross section of the sacrificial material used to form the channels 250. Of course, the sacrificial material that forms the reservoir 260 will also re-flow, rounding its corners. A second permanent layer 216 is then deposited on or over the entire substrate 210, including the first permanent layer 215, as well as on or over the sacrificial material 240 used to form the nozzle channels 250 and the reservoir 260. This second permanent layer 216 will provide the roof and walls of the channels 250 and the fluid reservoir 260 after the sacrificial material 240 is removed. In various exemplary embodiments, because the second permanent layer 216 is deposited over the sacrificial material 240, the second permanent layer 216 has a greater layer thickness as deposited than the first permanent layer 215.

In various exemplary embodiments, if a photoresist is used as the sacrificial material, when depositing the second permanent layer 216, it is important to keep the substrate temperature below about 90°–100° C. to prevent polymerization of the photoresist in the micro channel 250. Polymerization is desirably avoided, as polymerization can make the photoresist difficult to remove later. In various exemplary embodiments, the substrate is maintained at or near room temperature (e.g., 20°–30° C.) when depositing the second permanent layer 216.

Figure 2:
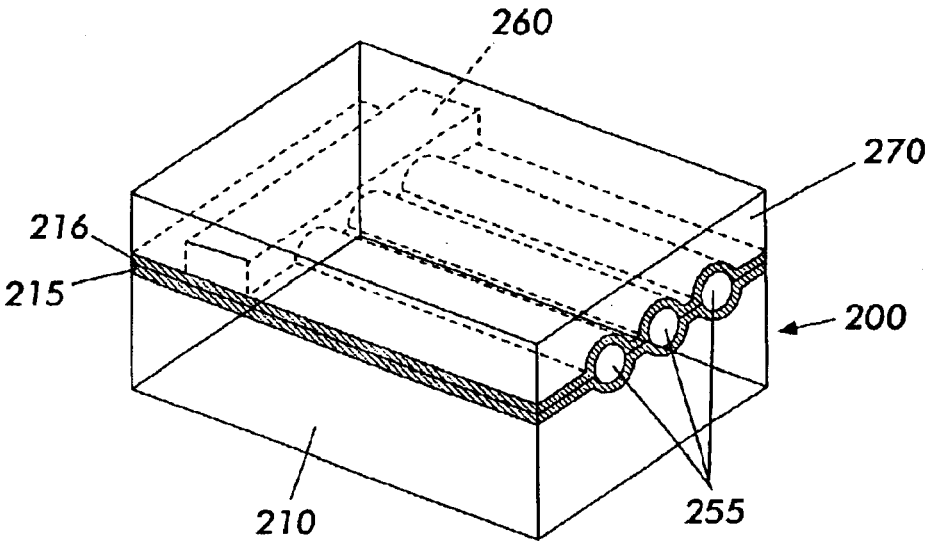
FIG. 2 is a perspective view of another step of one exemplary embodiment of a fluid ejector head manufacturing process according to this invention.

In FIG. 2, a layer 270 of a fluid resistant material, such as polyimide, SU-8, PAE or other appropriate material, is deposited on or over the second permanent layer 216. The top of the substrate 210, including the nozzle channels 250 and fluid reservoir 260, covered by the second permanent layer 216, are encapsulated with the fluid-resistant layer 270.

Figure 3:
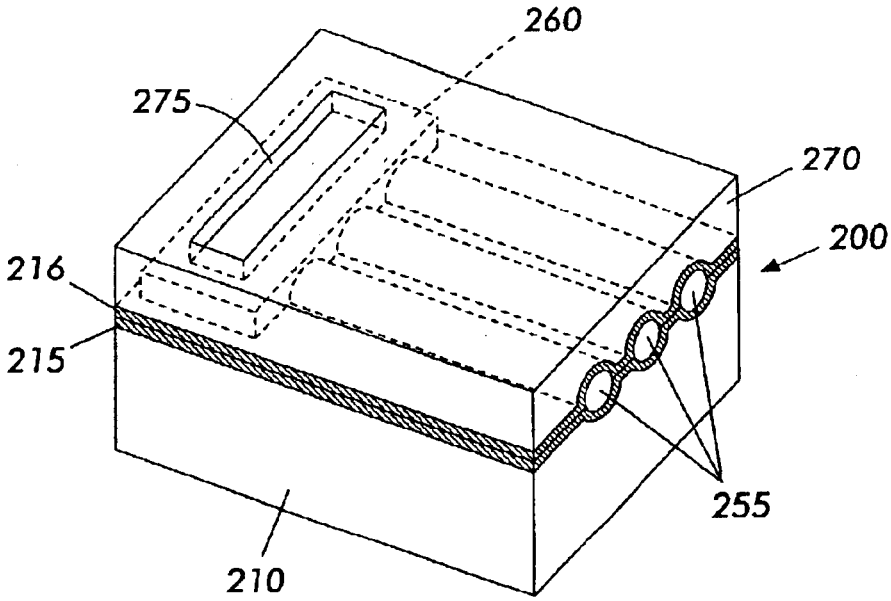
FIG. 3 is a perspective view of another step of one exemplary embodiment of a fluid ejector head manufacturing process according to this invention including forming a fluid inlet.

As illustrated in FIG. 3, in various exemplary embodiments, the layer of fluid resistant material 270 is etched, photopatterned, or otherwise altered to open up one or more fluid inlets 275 that fluidly connect to the fluid reservoir 260 defined by the second permanent layer 216. In various exemplary embodiments, after the inlets 275 are formed, the fluid resistant layer 270 is cured, and the surface is planarized, such as, for example, by chemical-mechanical polishing or any known or later-developed appropriate abrasion or other suitable abrasion method. In various exemplary embodiments where the fluid resistant layer 270 is a polymer layer, the inlet 275 can be made by plasma etching the polymer layer 270 after the polymer layer 270 is cured.

Figure 4:
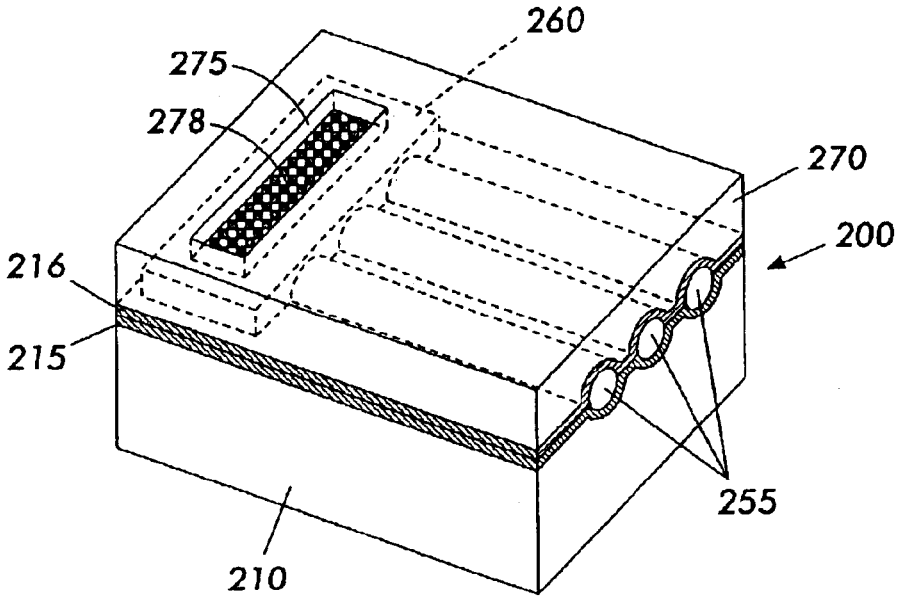
FIG. 4 is a perspective view of another step of one exemplary embodiment of a fluid ejector head manufacturing process according to this invention including forming an in situ filter on top of a fluid reservoir by etching the top of the reservoir.

As illustrated in FIG. 4, the exposed portion of the second permanent layer 216 that is exposed at the bottom of the inlet 275 and that forms at least a portion of the roof of the fluid reservoir 260, can be provided with a pattern of holes to produce an in-situ filter 278 for filtering micro contaminants from the fluid flowing through the fluid path. In various exemplary embodiments, this pattern is created by plasma etching the exposed portion of the second permanent layer 216. This process makes control over filter properties simple and allows filter pore diameters down to 1 micron or less, depending on the thickness of the second permanent layer 216. If a filter is not desired, the exposed portion of the second permanent layer 216 can be etched to effectively form a non-filtering opening directly into the fluid reservoir 260, as illustrated in FIG. 3.

The resulting multi-layer wafer 200 can now be diced to separate the ejector head regions into individual die modules 290 by conventional dicing techniques. A front face coating can also be applied to the diced surface that the nozzle channels open onto at this point, eliminating priming issues caused by hydrophobic coatings entering and lining the inside walls of the nozzle openings 255 and/or the fluid channels 250. If the multi-layer wafer 290 is diced before the sacrificial material 240 is removed, the nozzle openings 255, channels 250 and reservoir 260 will be protected by the sacrificial material 240. As a result, problems such as chipping of the front face of the ejector heads and/or the nozzle openings 255, contamination due to dicing debris and wafer bonding adhesive entering the nozzle openings 255 and/or the fluid channels 250, wafer/polymer layer misalignment and/or delamination of layers are reduced, and, ideally, are eliminated. Because the individual die modules 290 have not been formed by adhesive bonding of multiple layers, contamination due to adhesives in the fluid path and rejected ejector heads due to misalignment are also reduced. This should increase yield percentages in the manufacturing process.

After any desired dicing, etching, and/or front face coating steps are complete, the individual ejector heads 290 diced from the multi-layer wafer 200 must be processed to remove the sacrificial material, leaving the network of negative spaces forming the nozzle openings 255, the channels 250 and the fluid reservoir(s) 260 open for fluid flow. In various exemplary embodiments where the sacrificial material 240 can be dissolved by a solvent, the sacrificial material 240 is removed by soaking the die modules 290 in the solvent for a period of time. In various exemplary embodiments where the sacrificial material is a dissolvable photoresist, a solvent such as acetone, n-metryl pyroligne (NMP) or a commercial photoresist stripping solution can be applied for up to several hours with or without agitation and/or heating. In various other exemplary embodiments, if the sacrificial material comprises a photo-definable polymer, then a suitable solvent can be used to remove the polymer from the nozzles 255, the channels 250 and the reservoir(s) 260.

Figure 5:
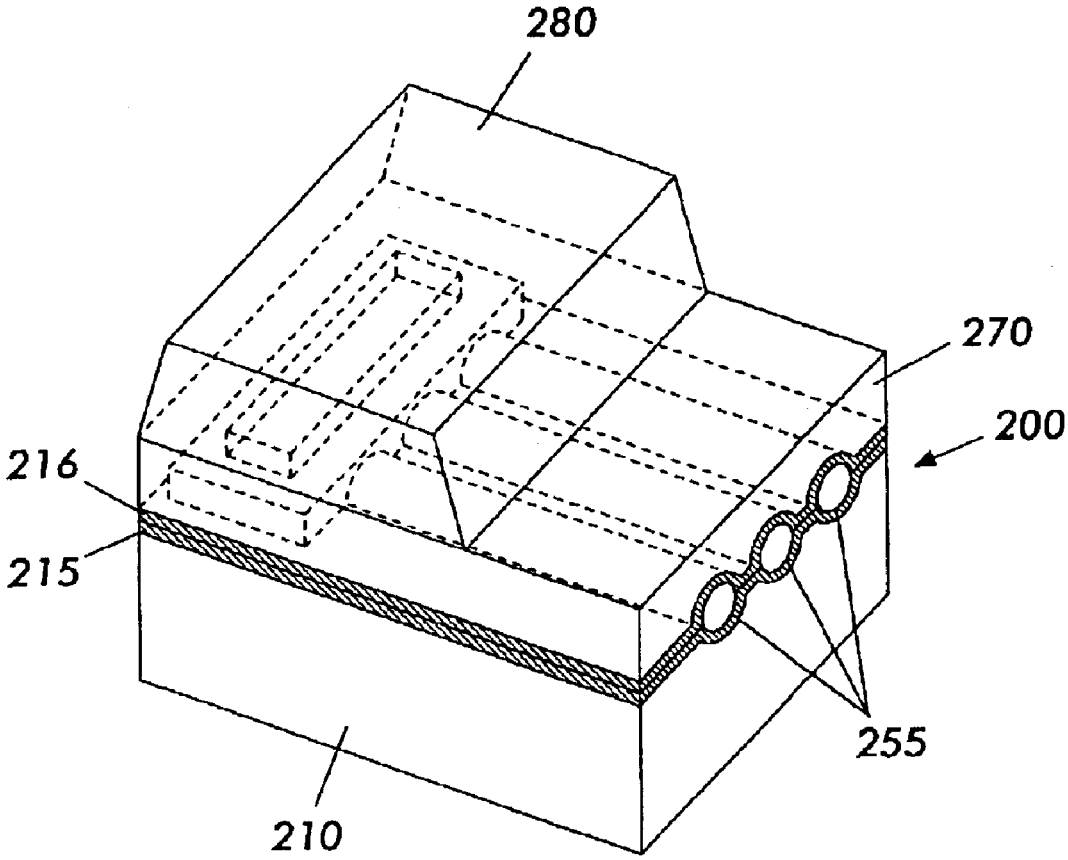
FIG. 5 is a perspective view of another step of one exemplary embodiment of a fluid ejector head manufacturing process according to of this invention.

As shown in FIG. 5, the individual die modules 290 can be attached to a heat sink or other suitable substrate (not shown) and attached to a fluid manifold 280. In various exemplary embodiments, the fluid manifold 280 is connected to the top of a die module 290 using a suitable fluid seal adhesive. The fluid manifold 280 can be attached to the fluid supply using standard cartridge design techniques. Wire bonds (not shown) can be used to connect the heaters and other ejector head circuits to the ejector controller.

In various exemplary embodiments, the ejector head 290, illustrated in FIGS. 1–5, may be partially manufactured according to conventional methods of forming micro channels in a substrate. For example, U.S. Pat. No. 6,096,656, incorporated herein by reference in its entirety, teaches a method of forming micro channels that may be used in conjunction with various exemplary embodiments of the devices and methods according to this invention.

Figure 6:
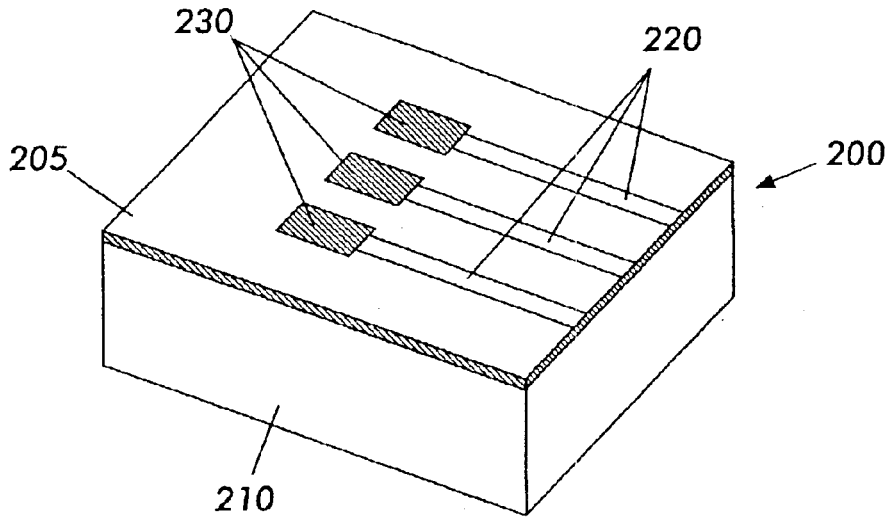
FIG. 6 is a perspective view of a candidate substrate usable in various exemplary embodiments of a fluid ejector head manufacturing process according to this invention.

FIG. 6 illustrates a candidate substrate 210 usable with a fluid ejector manufacturing process described above that is in part formed according to the methods disclosed in the '656 patent. The substrate 210 is silicon or other suitable substrate material. The substrate 210 contains a plurality of heater elements 230 and electronic circuits (not shown) usable to control the heater elements. Alternatively, pressure-increasing elements, such as piezoelectric elements (not shown), may be used in place of the heater elements 230 to cause fluid to be ejected from the ejector head. As shown in FIG. 6, a patternable layer 205, such as, for example, a photoresist layer or a hard mask, is formed on or over the surface of the wafer 200. One or more slots 220 are patterned in the patternable layer 205 in the desired channel positions 220 just ahead of the heaters 230. This will enable etching through the slots 220 into the substrate 210 to form the cavities that will become the channels and nozzles.

The substrate 210 is then isotropically etched through the slots 220 to begin forming the channels 225 in the substrate 210. In various exemplary embodiments, each channel is formed by etching the substrate 210. In various other exemplary embodiments, the channels 225 can be formed at least in part by any appropriate known or later-developed technique, including mechanical abrasion, molding, ion milling or laser ablation. In an exemplary etching process, the masked substrate 210 is exposed to an isotropic wet etchant, which removes material from the substrate 210 through non-preferential downward and lateral etching, channels with curved walls having cross sectional dimensions determined by the dimensions of the slots 220 in the patternable layer 205.

In various exemplary embodiments where the substrate is a silicon material, an isotropic silicon etchant, such as nitric/HF/acetic acids or a variant of a KOH etchant, is used to etch semi-cylindrical channels 225 in the silicon substrate 210. The exact cross-sectional shape of each channel 225 will depend upon the process selected to form the cavity, and upon the particular use the channel 225 is to be put in. In various exemplary embodiments, the channels 225 are formed in a half-cylindrical shape. Accordingly, isotropic etching, molding or laser ablation may be used. In various other embodiments, the channels 225 are formed in other shapes, such as half ovals, rectangles, squares and triangles. Such other cross-sectional shapes for the channels 225 are possible by using different etching process. For example, a channel 225 with angled side walls can be formed by an anisotropic wet etching that stops at particular crystalline planes. Exemplary anisotropic wet etchants include potassium hydroxide, tetra melthyl ammonium hydroxide or ethylenedioxide pyrocatechol.

Figure 7:
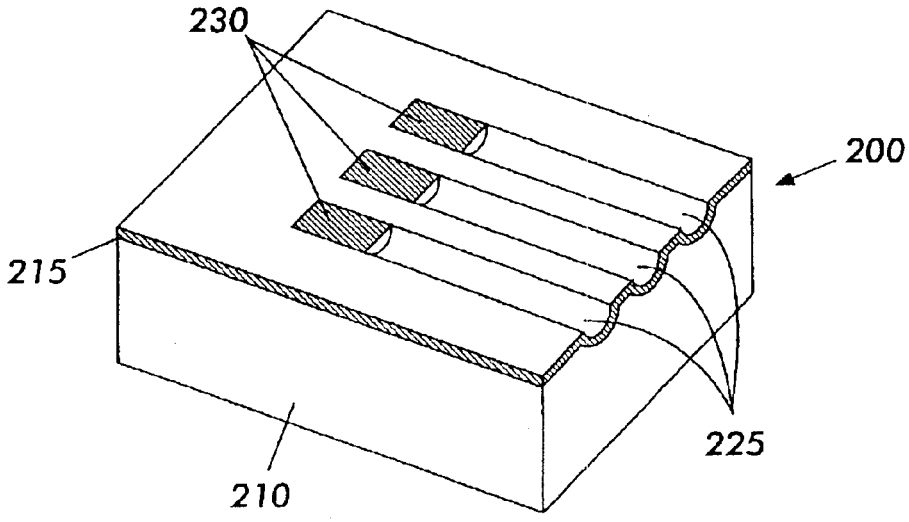
FIG. 7 is a perspective view of one exemplary embodiment of a substrate and micro channels of a fluid ejector head according to this invention.

In FIG. 7, the patternable layer 205 is removed from the substrate 210 to reveal the channels 225 in the substrate 210. Then, the first permanent layer 215 is deposited on or over the channels 225 and the substrate 210. In various exemplary embodiments, the first permanent material used to form the first permanent layer 215 will be the same material used to form the second permanent layer 216 described above. The first permanent layer 215 will form the walls of the nozzle channels 250 and can also be used to passivate the surface of the substrate 210 from the fluid. As with the second permanent layer 216, in various exemplary embodiments, a nitride material, such as, for example, a silicon oxynitrate and/or other similar material, can be used to form the first permanent layer 215. In various exemplary embodiments, the first permanent layer 215 is deposited using a high-density plasma deposition process. If a mask is not used, it may be necessary to pattern and etch holes in the first permanent layer 215 to expose the heater surfaces 230 and bonding pads of the ejector head electronic circuits (not shown).

Figure 8:
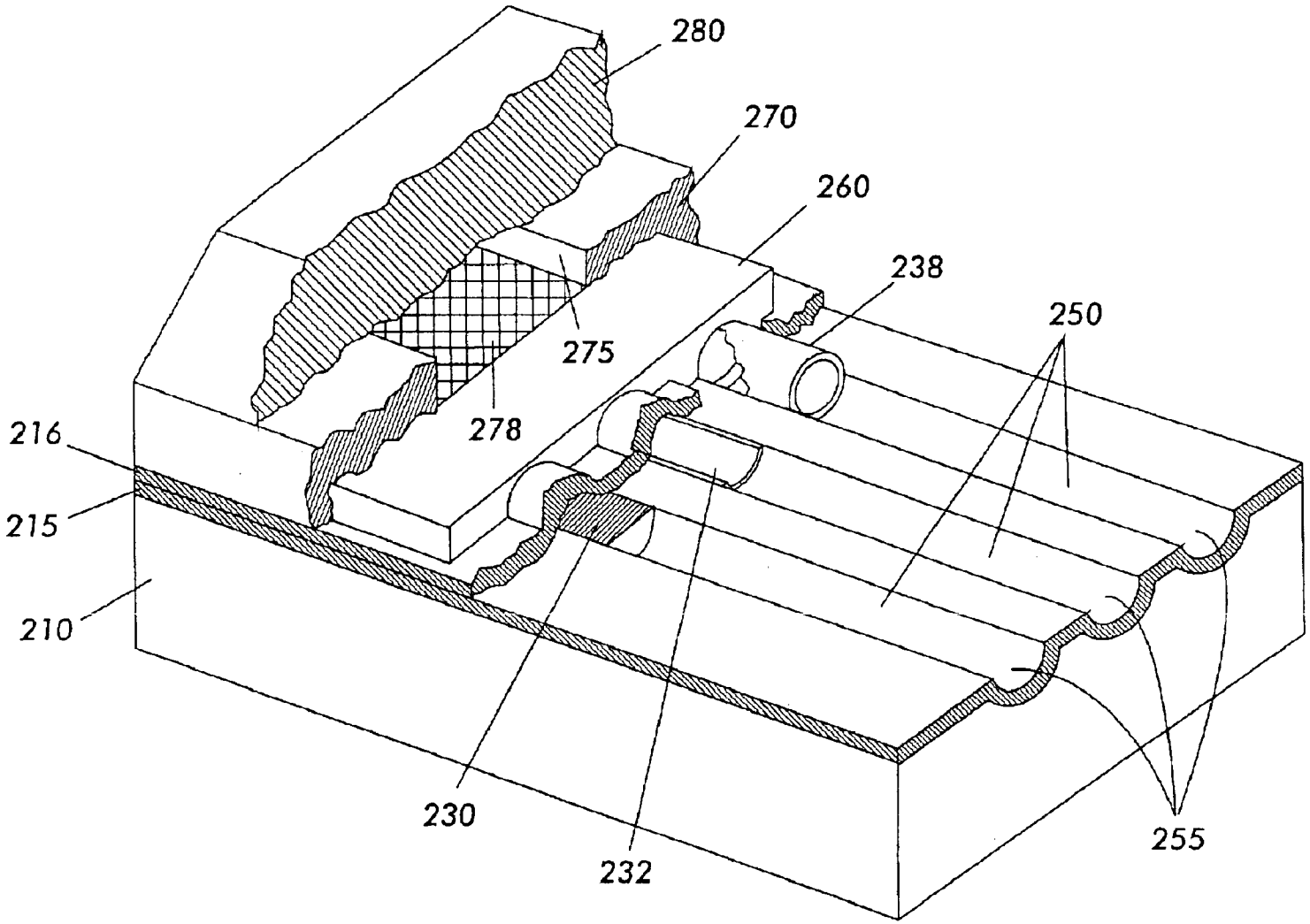
FIG. 8 is a perspective view of the in situ filter, internal negative space components and heating elements according to this invention.

FIG. 8 illustrates an internal view of various fluid path components of a number of different exemplary embodiments of the fluid ejector head according to this invention. The fluid path components include one or more of the fluid inlet 275, an in-situ fluid filter 278, the fluid reservoir 260 and the fluid channels 250. According to this invention, various novel fluid heating device designs are possible. For convenience sake, FIG. 8 illustrates three different fluid heater designs. However, it should be appreciated that a single fluid ejector head will commonly employ only a single design.

In FIG. 8, in a leftmost fluid channel 250, a conventional planar fluid heater 230 is formed at a back end of the fluid channel 250. As described in FIG. 6, in various exemplary embodiments, such a planar heater 230 will be deposited on the substrate 210 prior to forming the channels 225. The channels 225 will terminate at the edge of the planar heater 230. Conventional thin film deposition methods can be used to form the planar heater 230. In an exemplary process for forming the conventional planar heater 230, a mask that has openings over the desired locations of the heaters is applied to the substrate 210. The openings are then etched to form cavities having a suitable depth for forming the heaters. Next, by sputtering or other suitable thin film deposition methods, a conductive material is deposited over the substrate 210 to form the heaters 230. When the sacrificial material 240 is formed on or over the surface of the substrate 210, patterned, and optionally reflowed, the patterned sacrificial material 240 extends over the planar heater element 230. Then, when the second permanent layer 216 is formed on or over the sacrificial material 240 and the sacrificial material 240 is removed, the negative space of the fluid channel 250 extends over the planar heater element 230.

FIG. 8 also illustrates a second exemplary embodiment of the heater element 234. In this second exemplary embodiment, the semi-cylindrical heater 234 is formed within the fluid channel 250 and extends partially around at least one of the first and second permanent layers 215 and 216. In various exemplary embodiments, at least a portion of the semi-cylindrical heater 234 is formed after the micro channels 250 are etched on the substrate and first permanent layer 215 is deposited in the channels 250 and on the wafer 210 but before the sacrificial material 240 is deposited. A thin film deposition method such as that used in forming the planar heating element 230 can be used to deposit and form a conductive material layer that can be patterned to form the semi cylindrical heater 234. It should be appreciated that, in various exemplary embodiments, some, or even all, of the semi cylindrical heater element 234 can be formed after the sacrificial material 240 is formed (and optionally after it is reflowed), but before the second permanent layer 216 is formed. It should also be appreciated that the semi-cylindrical heater element 234 can extend in various amounts around the first permanent layer 216 in the channel 225 and/or around the sacrificial material 240. These various amounts extend from a few degrees around, to almost entirely around, the perimeter of the sacrificial material 240. By surrounding more of the fluid in the channel 250 than the planar heater 230, the semi-cylindrical heater 234 can provide improved heating of the fluid over the planar heater 230 and may increase fluid ejection velocities.

FIG. 8 illustrates a third exemplary embodiment of a fluid heater-element 238 according to this invention. In this exemplary embodiment, the fully-cylindrical heater element 238 is formed within the fluid channel 250. The fully cylindrical heater element 238 completely extends around at least a portion of the fluid channel 250 to provide uniform heating of fluid in the fluid channel 250. This fully-cylindrical heater element 238 can provide improved evenness of heating over both the conventional planar heater element 230 and the semi-cylindrical heater element 234, and may increase fluid ejection velocities over these heaters.

In various exemplary embodiments, the fully-cylindrical heater element 238 is formed in a two-step process. After the channels 225 are formed and the first permanent layer 215 is deposited, the first half of the fully-cylindrical heater element 238 can be formed on or over the first permanent layer 215. The first half of the cylindrical heater element 238 is formed by depositing a conductive material on or over a portion of the first permanent layer 215 within each channel 225 at a location away from the nozzle opening 255 and then patterning the deposited layer of conductive material. The channel 225 is then filled with a layer of sacrificial material that covers the fluid channel and the first half of the cylindrical heater element 238. Prior to applying the second permanent layer 216 to form the top of the fluid channels 250 and the fluid reservoir(s) 260, the top half of the fully-cylindrical heater element 238 is formed on or over the patterned sacrificial layer 240 within the channel 225.

In various exemplary embodiment, the second layer of conductive material is deposited on or over the sacrificial layer 240 aligned with the first half of the cylindrical heater element 238 to define the cylindrical or tubular heater element 238. The second permanent layer 216 is than deposited on or over the entire structure, including the sacrificial material 240 that forms the channels 250, the first permanent layer 215 and the fluid reservoir(s) 260, and the cylindrical heater element 238. When the sacrificial material 240 is removed, the fluid can flow from the fluid inlet 276 through the cylindrical or tubular heating element 238.

While, particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A method for forming a fluid path for a fluid ejection device, comprising:

forming at least one channel in a substrate;

depositing a first permanent material layer on or over the substrate and the channel;

depositing a sacrificial material on or over the first permanent material layer and the at least one channel;

patterning the sacrificial layer to form a plurality of channel structures and at least one fluid reservoir structure connected to the plurality of channel structures;

depositing a second permanent material layer on or over the patterned sacrificial material and the first permanent material layer;

depositing a fluid resistant layer over the second permanent material layer;

forming at least one fluid inlet in the fluid resistant layer, the at least one fluid inlet positioned over the at least one fluid reservoir, the fluid inlet extending at least partially through the second permanent material layer;

forming at least one hole in the second permanent material layer within the boundary of the at least one fluid inlet; and removing the sacrificial material to form at least one fluid reservoir fluidly connected to the at least one fluid inlet and a plurality of fluid channels fluidly connected to the at least one fluid reservoir.

2. The method of claim 1, wherein several fluid ejection devices are formed simultaneously in a single substrate, the method further comprising dicing the single substrate into individual fluid ejection devices prior to removing the sacrificial material.

3. The method of claim 1, wherein forming the at least one hole in the second permanent material layer further comprises forming an in-situ fluid filter in the second permanent material layer, the in-situ fluid filter positioned over the fluid reservoir.

4. The method of claim 1, wherein forming the at least one hole in the second permanent material layer further comprising forming an opening through the second permanent material layer into the at least one fluid reservoir.

5. The method according to claim 1, when forming at least one channel comprises forming a mask on a substrate, the mask defining at least one opening, and removing material from the substrate through the at least one opening to form a channel opening in the substrate.

6. The method according to claim 1, wherein depositing the sacrificial material comprises depositing at least one of at least a photoresist material and a photo-alterable polymer material.

7. The method according to claim 1, wherein patterning the sacrificial material comprises:

leaving the sacrificial material in the plurality of channel structures; and reflowing the remaining sacrificial material to form a rounded cross section.

8. The method according to claim 1, wherein depositing the first permanent material layer comprises depositing a first nitride layer.

9. The method according to claim 1, wherein depositing the second permanent material layer comprises depositing a second nitride layer.

10. The method according to claim 1, further comprising forming at least one heating element in, on or over the substrate.

11. The method of claim 10, wherein forming the at least one heating element comprises forming a planar heater in at least some of the plurality of channel structures.

12. The method of claim 10, wherein forming the at least one heating element comprises forming a semi-cylindrical heater in at least some of the plurality of channel structures.

13. The method of claim 10, wherein forming the at least one heating element comprises forming a fully cylindrical heater in at least some of the plurality of channel structures.

14. The method of claim 13, wherein:

forming the fully cylindrical heater comprises forming, for each of the at least some of the channel structures, a first portion of the fully cylindrical heater in a portion of that channel structure on or over the first permanent material layer;

depositing the sacrificial material comprises depositing the sacrificial material over the first portions of the fully cylindrical heater and the plurality of channel structures;

forming the fully cylindrical heater further comprises forming, for each of the at least some of the channel structures, a second portion of the fully cylindrical heater on or over the sacrificial material; and forming the second permanent material layer comprises forming the second permanent material layer on or over the second portions of the fully cylindrical heater.

15. The method of claim 13, wherein forming the second portions of the fully cylindrical heater comprises forming the second portions of the fully cylindrical heater so that the second portions of the fully cylindrical heater are aligned with the first portions of the fully cylindrical heater to form the fully cylindrical heater in the at least some of the plurality of channel structures.

16. A fluid ejection head comprising:

a substrate having a plurality of channels formed therein, each channel terminating at an outside face of the substrate;

a first permanent material layer formed on or over the substrate and the plurality of channels;

a second permanent material layer formed on or over the first permanent material layer, wherein the first and second permanent material layers are shaped to define a plurality of fluid ejection channels relative to the plurality of channels formed in the substrate and at least one fluid reservoir that is fluidly connected to the plurality of fluid ejection channels;

a fluid resistant layer formed on or over at least the second permanent material and encapsulating the plurality of fluid ejection channels and at least one fluid reservoir;

at least one fluid inlet formed in the fluid resistant layer that extends down to the at least one fluid reservoir, the at least one fluid inlet including at least one hole extending through the second permanent layer to fluidly connect the at least one fluid inlet to the at least one fluid reservoir.

17. The fluid ejector head according to claim 16, wherein the fluid ejection channels have a round cross section.

18. The fluid ejector head according to claim 16, further comprising at least one heating element, each heating element formed in, on or over the substrate and fluidly within one of the plurality of fluid ejection channels.

19. The fluid ejector head according to claim 18, wherein at least some of the at least one heating element comprise a planar heater element.

20. The fluid ejector according to claim 18, wherein at least some of the at least one heating element comprise a partially cylindrical heater, each partially cylindrical heater located within and extending partially around one of the plurality of fluid ejection channels.

21. The fluid ejector according to claim 18, wherein at least some of the at least one heating element comprise a cylindrical heater, each cylindrical heater located within and extending completely around one of the plurality of fluid ejection channels.

22. The fluid ejector according to claim 16, wherein the at least one hole extending through the second permanent layer to fluidly connect the at least one fluid inlet to the at least one fluid reservoir comprises a single hole extending over a substantial portion of the area of the fluid inlet.

23. The fluid ejector according to claim 16, wherein the at least one hole extending through the second permanent layer to fluidly connect the at least one fluid inlet to the at least one fluid reservoir comprises a plurality of holes sized to form an in-situ fluid filter.

* * * * *